United States Patent [19]

Graf

[11] Patent Number: 4,646,789

[45] Date of Patent: Mar. 3, 1987

[54] CONTACT BAR ASSEMBLY FOR A WARP STOP MOTION OF A LOOM

[75] Inventor: Martin Graf, Horgenberg, Switzerland

[73] Assignee: Grob & Co. Aktiengesellschaft, Horgen, Switzerland

[21] Appl. No.: 863,889

[22] PCT Filed: Aug. 9, 1984

[86] PCT No.: PCT/CH84/00125

§ 371 Date: Apr. 7, 1986

§ 102(e) Date: Apr. 7, 1986

[87] PCT Pub. No.: WO86/01236

PCT Pub. Date: Feb. 27, 1986

[51] Int. Cl.[4] ..... D03D 51/28

[52] U.S. Cl. ..... 139/358; 139/369

[58] Field of Search ..... 139/353, 358, 359, 369

[56] References Cited

U.S. PATENT DOCUMENTS

| | | | |
|---|---|---|---|
| 1,719,234 | 5/1928 | Noyes | 139/369 |
| 3,246,091 | 4/1966 | Koch | 139/353 |
| 3,817,293 | 6/1974 | Childs | 139/369 |

FOREIGN PATENT DOCUMENTS

| | | |
|---|---|---|
| 573435 | 6/1924 | France . |
| 22387/86 | 2/1975 | France . |
| 430611 | 8/1967 | Switzerland . |

*Primary Examiner*—Henry S. Jaudon

*Attorney, Agent, or Firm*—Watson, Cole, Grindle & Watson

[57] ABSTRACT

A contact bar assembly for the warp stop motion of a loom includes an inner bar (1) having a beam-shaped part (2) of insulating material at the upper edge of which a groove (5) is provided for the reception of a metallic serrated bar (6), and the entire inner bar can longitudinally reciprocate in an outer bar (8) of a U-shaped cross section. The outer bar (8) has longitudinally spaced slots (12) each for the reception of a guide piece (12) of synthetic material which can easily be inserted and removed, each guide piece having a longitudinal slot (13) with a larger configuration (14) at its lower section. The beam-shaped part (2) of synthetic material has a lower section of T-shaped cross-section (4) and (10) which engages with slot (13) and its larger configuration (14) for holding and guiding the inner bar (1) in such a manner that a vertical separation of the inner bar from the outer bar is prevented, although the inner bar is capable of longitudinal reciprocation in the outer bar (8). The longitudinal edge of the inner bar located beyond the free ends of the legs of the U shaped outer bar has about the same thickness as the outer bar and covers a slot (9) of the outer bar (8) to prevent entry of fluff and dust.

5 Claims, 8 Drawing Figures

CONTACT BAR ASSEMBLY FOR A WARP STOP MOTION OF A LOOM

The invention relates to a contact bar assembly for the warp stop motion of a loom and comprises a metallic outer bar of U-shaped cross section and an inner bar housed partly within the outer bar, electrically insulated, which can be longitudinally reciprocated in the outer bar and which is serrated across the width of the top edge.

With a known contact bar assembly of such type (Swiss Pat. No. 430611), the inner bar is housed deeply within the legs of the outer bar of U-shaped cross section and is separated by insulating plates from these legs of the outer bar, whereby the total width of the contact bar assembly becomes very thick and the associated drop wires will have to include a correspoonding wide contact slot. This known assembly does not permit a complete removal of the inner bar from the outer bar for cleaning or repair purposes, since a bolt extends transversely through the legs of the outer bar and through a slot of the inner bar, resulting that reciprocation of the inner bar is limited and can only perform in a manner which corresponds with the length of the slot. The cross bolt which is firmly arranged in the outer bar prevents a complete removal of the inner bar from the outer bar.

In order to render the cross section of the contact bar assembly narrower, it is futhermore known (DE-OS No. 2340714) to make the inner bar only of insulation material having a narrow cross section fitting in between the two legs of the outer bar and which has one longitudinal edge located beyond the free ends of the legs from the bight of the U onto which a conductive and serrated bar is mounted in order to provide sufficient vertical space between the outer bar and the metallic conductive part to ensure adequate insulation, so that moist fluff and dust sticking on the surface of the outer and inner bars may not lead to short circuit and subsequent faulty stoppages of the loom.

With this known contact bar assembly, the inner bar is not guided and maintained in such a manner that a longitudinal reciprocation and a complete removal of the inner bar from the outer bar for cleaning or repair purposes is possible, and a separation of the inner bar from the outer bar in a vertical direction from the slot or bight of the outer bar is not possible.

The principal object of the present invention is to provide a contact bar assembly, the two bars of which-without major expenditure in manufacture concerning the shape of the outer bar and the inner bar-being coupled and guided for longitudinal reciprocation movement such, that the inner bar can be easily and completely removed from the outer bar, and that, however, during operation the inner bar cannot be taken out in vertical direction from the bight or slot of the U of the outer bar. Such longitudinal guidance while at the same time preventing a disengagement in vertical direction should be accomplished by simple means and, moreover, it should, by simple means, prevent dirt or fluff from entering between the bight of the U of the outer bar and the surfaces of the inner bar. The contact bar assembly according to the invention carries out this broad objective and has the advantages that the necessary parts needed for the longitudinal guidance and coupling arrangement of the inner bar to the outer bar is reasonable in price and easy to assemble. The openings made at intervals in the outer bar will appropriately be configured as slots extending transversely through the outer bar, whereby an appropriate guide piece preferably made of synthetic material having the shape of the slot fits exactly into the same. The guide piece is preferably held by means of snap fastening in the outer bar, and for this reason, the guide piece is appropriately configured with a protrusion at the centre of its lower edge, and above the same, is configured with a slot which makes it possible that the protrusion can resiliently snap into the slot of the outer bar of U-shaped cross section.

Further details and advantages will be understood from the following description in which an embodiment is explained with reference to the accompanying drawing of which:

Figure 1:
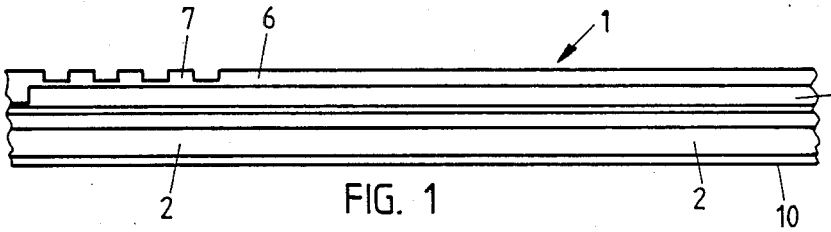
FIG. 1 is a view of the inner bar in side-elevation
Figure 2:
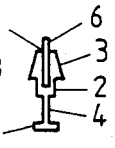
FIG. 2 is an end view of the inner bar according to FIG. 1
Figure 6:
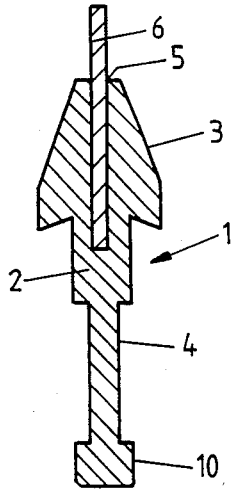
FIG. 6 is a sectional view taken through the inner bar only along line I—I of FIG. 3

The inner bar 1 according to FIG. 1 consists of a beam-shaped part 2 of insulating material and having a T-shaped section 4, 10 at the lower section of part 2, the cross section of which part 2 is illustrated in FIG. 2 and in an enlarged scale in FIG. 6. Its upper section 3 is configured broader than its lower section 4 and the broader section diminishes roof-like towards the upper longitudinal edge, where a groove 5 extends into part 2 of insulating material. A metallic and conductive bar 6 provided with a uniform serration 7 on its upper edge is firmly embedded into the groove 5.

Figures 4, 5:
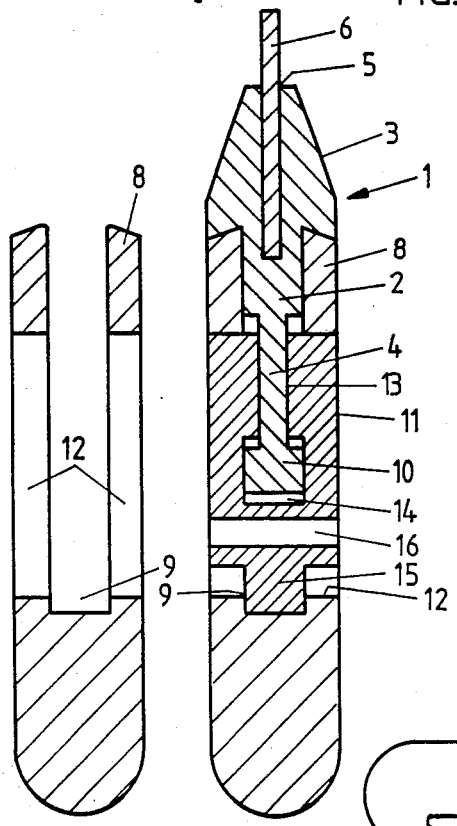
FIG. 4 is a sectional view taken through the outer bar only along line I—I FIG. 3 in an enlarged scale
FIG. 5 is a sectional view taken through the outer bar and inner bar along line I—I of FIG. 3

As shown in FIG. 5, the width of the roof-shaped section 3 of the part 2 of the inner bar 1 corresponds at its base with the outside width or thickness of the outer bar 8 of U-shaped cross section into which the inner bar is partly housed, whereby the roof-shaped section 3 of the inner bar covers the outer bar 8 on its upper longitudinal edges resulting that the slot 9 of the outer bar 8 is also covered and subsequently no dust, fluff or dirt can enter.

Figure 3:
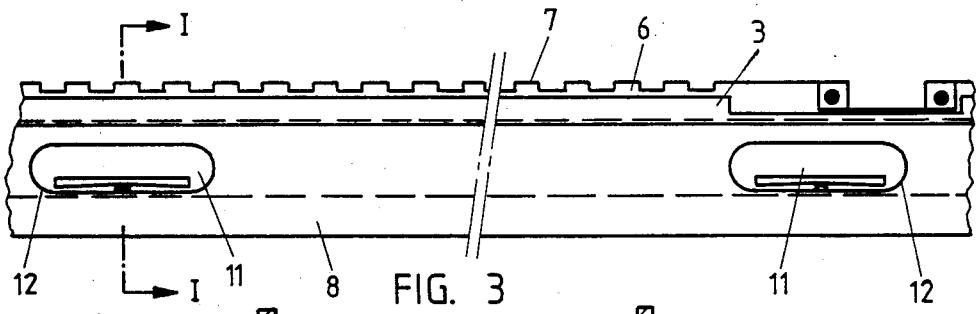
FIG. 3 is a side view of the contact bar assembly consisting of outer bar and inner bar with two guide pieces fitted in the outer bar at an interval

Part 2 of the inner bar 1 has at its lower edge a longitudinally T-shaped configured border part 10. The inner bar 1 is kept in the outer bar 8 by means of a number of guide pieces 11, fitted at longitudinal intervals from eachother into the outer bar 8, as shown in FIG. 3, whereby the longitudinal border part 10 of the inner bar engages into the guide pieces 11, effecting that the inner bar 1 cannot be raised from the slot 9 of the outer bar 8, that it however can reciprocate longitudinally in its full length in the outer bar 8.

The guide pieces 11 are fitted in the openings which are configured preferably as slots 12 which extend transversely through the outer bar 8 as can be seen in FIG. 4 in the enlarged scale.

Figure 7:
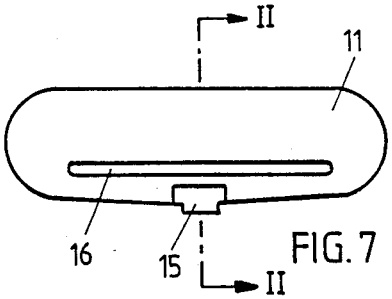
FIG. 7 is a view in side-elevation of the guide piece in a larger scale than shown in FIG. 3
Figure 8:
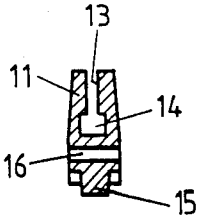
FIG. 8 is a sectional view taken through the guide piece line II—II of FIG. 7.

In FIGS. 7 and 8 the guide piece 11 is illustrated in enlarged scale. The guide piece 11 is preferably made of synthetic material and is provided at the upper edge with a longitudinally extending slot 13, the bottom of which forms an enlarged recess 14. Part 2 of the inner bar 1 fits with its section 4 into the slot 13 and the lower larger border part 10 of the inner bar fits into the enlarged recess 14 appropriately configured at the base of the slot 13. With this arrangement, a longitudinal reciprocation of the inner bar 1 in relation to the outer bar 8 is accomplished, as clearly illustrated in FIG. 8. The guide piece 11 fills the slot 12 completely and has the same thickness as the one of the outer bar 8.

The guide piece 11 is secured in the outer bar 8 by means of a snap fastening device in order to fit and remove it in a simple and easy manner. For this purpose, the guide piece 11 is configured at the centre of the lower edge with a protrusion 15 which has about the same thickness as the opening of slot 9 in the outer bar 8. Above the protrusion 15 of the guide piece 11, there is a slot 16 extending tranversely through the guide piece 11 giving a springy or resilient effect of the lower section of the guide piece 11 with the protrusion 15 which enables the insertion and subsequently the snapping in of the guide piece 11 with its protrusion 15 into the slot 9 in the outer bar 8 when the guide piece is secured in the opening 12. The guide piece 11 couples therefore the inner bar 1 firmly with the outer bar 8 preventing a removal of the inner bar 1 in vertical direction from the outer bar 8, however permitting a longitudinal reciprocation of the inner bar without any limitation in the outer bar.

What is claimed is:

1. A contact bar assembly for the warp stop motion of a loom, comprising a metallic electrically conductive outer bar of a U-shaped cross-section and an electrically insulated inner bar housed partly and guided in said outer bar, said inner bar having an upper longitudinal serrated edge, said outer bar having longitudinally spaced openings extending transversely therethrough, a guide piece being received with each of said openings, each said guide piece having a slot extending longitudinally of the axis of said outer bar, a lower section of said slot having an enlarged configuration, said inner bar being of insulating material and having a beam-shaped part extending substantially along the entire length of the bar assembly, said part having a lower section of T-shaped cross-section which corresponds to that of said slot and said enlarged configuration thereof, said T-shaped lower section of said part being received within said slot and said enlarged configuration for longitudinal guiding movement therealong and for thereby preventing said inner bar from being removed in a vertical direction from said outer bar.

2. The contact bar assembly according to claim 1, wherein each of said openings in said outer bar and each said guide piece is of the same size and shape.

3. The contact bar assembly according to claim 1, wherein each said guide piece is of non-metallic material.

4. The contact bar assembly according to claim 1, wherein said outer bar has a slot at each of said openings, each said guide piece having a protrusion at its lower edge engaged in said slot, each said guide piece also having a through slot located above said protrusion for spring retaining each said guide piece within each of said openings in said outer bar.

5. The contact bar assembly according to claim 4, wherein said beam-shaped part has an outwardly open longitudinal slot at the upper longitudinal edge thereof, a metallic bar having said serrated edge being snugly received within said longitudinal slot, said beam-shaped part having a roof-shaped section extending from said longitudinal slot and overlying the length of said outer bar, said roof-shaped section having a width equal to the thickness of said outer bar so as to prevent the entry of fluff and dust into said slot at each of said openings.

* * * * *